US005477972A

United States Patent [19]

Lester

[11] Patent Number: 5,477,972

[45] Date of Patent: Dec. 26, 1995

[54] TAMPER EVIDENT CLOSURE DEVICE FOR BOTTLES AND THE LIKE

[76] Inventor: William M. Lester, 651 W. Mount Pleasant Ave., Livingston, N.J. 07039

[21] Appl. No.: 252,722

[22] Filed: Jun. 2, 1994

[51] Int. Cl.[6] ..... B65D 55/02

[52] U.S. Cl. ..... 215/230; 215/250; 215/303; 220/278; 220/377

[58] Field of Search ..... 215/228, 230, 215/250, 303; 220/377, 212, 214, 277, 278

[56] References Cited

U.S. PATENT DOCUMENTS

| | | |
|---|---|---|
| 1,095,313 | 5/1914 | Davids . |
| 2,151,774 | 3/1939 | Koch . |
| 3,695,476 | 10/1972 | Ruekberg . |
| 3,782,574 | 1/1974 | Rumble . |
| 3,819,460 | 6/1974 | Dukess . |
| 3,826,221 | 7/1974 | Ross . |
| 3,837,518 | 9/1974 | Gach . |
| 3,899,295 | 8/1975 | Halpern . |
| 3,917,100 | 11/1975 | Dukess . |
| 3,923,198 | 12/1975 | Brochman . |
| 3,946,889 | 3/1976 | Gach . |
| 3,952,901 | 4/1976 | Conti . |
| 4,004,704 | 1/1977 | Hilaire . |
| 4,153,174 | 5/1979 | Keeler . |
| 4,378,894 | 4/1983 | Willis et al. . |
| 4,440,306 | 4/1984 | Van Buskirk et al. . |
| 4,446,979 | 5/1984 | Gach et al. . |
| 4,478,069 | 10/1984 | Zuckerwar . |
| 4,479,585 | 10/1984 | Sandhaus . |
| 4,480,760 | 11/1984 | Schonberger . |
| 4,489,841 | 12/1984 | Thompson . |
| 4,494,664 | 1/1985 | Guala . |
| 4,500,005 | 2/1985 | Forrester . |
| 4,522,307 | 6/1985 | Steiner . |
| 4,553,678 | 11/1985 | Thorsbakken . |
| 4,562,931 | 1/1986 | Brach et al. . |
| 4,570,809 | 2/1986 | Archer . |
| 4,576,297 | 3/1986 | Larson . |
| 4,579,240 | 4/1986 | Ou-Yang . |
| 4,588,098 | 5/1986 | Uzdy . |
| 4,591,062 | 5/1986 | Sandhaus . |
| 4,598,833 | 7/1986 | Herr . |
| 4,625,875 | 12/1986 | Carr et al. . |
| 4,634,013 | 1/1987 | Bar-Kokhba ..... 215/228 |
| 4,646,926 | 3/1987 | Agbay et al. . |
| 4,664,273 | 5/1987 | Simon . |
| 4,674,642 | 6/1987 | Towns et al. . |
| 4,754,889 | 7/1988 | Debetencourt . |
| 4,754,890 | 7/1988 | Ullman et al. . |
| 4,767,587 | 8/1988 | Towns et al. . |
| 4,770,305 | 9/1988 | Su . |
| 4,778,069 | 10/1988 | Keller . |
| 4,778,070 | 10/1988 | Walker . |
| 4,792,053 | 12/1988 | Towns et al. . |
| 4,793,122 | 12/1988 | Towns et al. . |

(List continued on next page.)

*Primary Examiner*—Allan N. Shoap
*Assistant Examiner*—Stephen Cronin

[57] ABSTRACT

Tamper indicating closure device for securely sealing a container in the form of a clear cap and indicator element. The cap includes knife blades in the form of ramp shaped projections which extend from the bottom side of the cap surface. Each knife blade is radially offset from the center of the cap and extends generally parallel to the radius of the cap terminating in a generally vertical planner knife face that extends in an axial direction. A tamper indicating element including a first covering layer and a second color layer is inserted into the cap prior to securing the cap and indicating element to a container. When the cap is screwed onto the container, the ramp like shape of the knife blades cause the knife blades to pass over the indicating element without tearing or piercing. When the cap is removed from a secured relationship with the container, the generally vertical knife face tears the cover layer of the indicating element exposing the color layer and thereby providing an indication of tampering. Because the knife blades do not pierce the indicating element during assembly, a sealing layer may be used to protect the contents of a container from the atmosphere without the need to flatten knife blades or apply sealant thereto to avoid the possible piercing of the sealing layer during assembly.

13 Claims, 5 Drawing Sheets

U.S. PATENT DOCUMENTS 4,793,503 12/1988 Towns et al. .
4,793,504 12/1988 Towns et al. .
4,793,505 12/1988 Towns et al. .
4,801,771 1/1989 Mizuguchi et al. .
4,819,819 4/1989 Robertson, Jr. .
4,828,127 5/1989 Young et al. .
4,830,206 5/1989 Fisher .
4,848,613 7/1989 Nofer .
4,848,614 7/1989 Csaszar .
4,919,285 4/1990 Roof et al. .
4,998,988 3/1991 Zinnbauer .
5,005,718 4/1991 Buono .
5,022,545 6/1991 Carson .
5,054,633 10/1991 Reijenga .
5,082,136 1/1992 Schumann ..... 220/278
5,092,477 3/1992 Johnson, Jr. .
5,097,974 3/1992 Rozenberg .
5,152,413 10/1992 Conrad .
5,190,175 3/1993 Schmidt .
5,255,813 10/1993 Berggren et al. ..... 220/278

TAMPER EVIDENT CLOSURE DEVICE FOR BOTTLES AND THE LIKE

FIELD OF THE INVENTION

The present invention is directed to tamper-indicating containers and, more particularly, to closures for providing containers with tamper indication.

BACKGROUND OF THE INVENTION

To assure the uncontaminated delivery of contained products to a consumer, and particularly medicinal products that are taken internally, there is a need for a container that includes an indicator that indicates to a consumer that the contents of the container have not been tampered with from their point of manufacture to the point of consumer sale.

A fundamental prior art approach toward meeting this need is seen in the so-called "telltale" indication, i.e., a readily discernible characteristic indicative of tampering, such as a signal that some person has previously attempted to gain access to the container contents. Broadly speaking, this approach can be generalized as placing a tamper-indicating member, e.g., a tell-tale, in the path of access to a container to indicate tampering by discernible change.

Prior art telltales may be categorized in respect of the relative location of the telltale to the container access port. For example, some known telltales are located directly at the access port spanning the access opening, e.g., are secured across the mouths of jars. Other known telltales, such as plastic sleeves which are heat shrunk about a capped jar, are located in the path of access to the container but not directly across the access port to the container. Because telltale items located outside a container cap may be removed leaving the remaining capped container without tamper indicating capability, telltales located directly at the access port spanning the access opening offer a higher degree of security than those located externally to the cap.

Of the various known telltale devices located directly at the access opening of a container, those that are closure member activated generally offer a higher degree of security than those that are not closure member activated. In the closure member activated category, reverse sensing (opening) movement of the closure member, e.g., cap, brings some element into tearing relation with the telltale.

U.S. Pat. Nos. 4,793,122 and 4,793,505 to Towns et al. (hereinafter "the Towns et al. patents") describe various arrangements for closure member activated tamper-indicating closure devices. However, the disclosed closure devices suffer from various manufacturing and use disadvantages which will be discussed with reference to FIGS. 1–5.

Referring now to FIG. 1 there is illustrated a representative embodiment of the known tamper-indicating closure devices described in the Towns et al. patents. As illustrated in FIG. 1, the known closure device comprises a hollow cap 10 including tines 12 for puncturing a tamper indicating element. As illustrated, the tines 12 are radially offset from the center of the rotative movements of the cap 10 and extend parallel to the axis of the hollow cylindrical cap 10. Thus, the primary extent of each tine 12 extends generally radially of the cap's center of rotation to provide a frontal expanse for rupturing or tearing of the indicating element when the cap 10 is rotated.

Referring now to FIG. 2, it can be seen that when assembled, by insertion of the indicating element 16 into the cap 10, the tines 12 pierce the indicating element 16. Referring now briefly to FIG. 5A, which is a top view of the cap assembly of FIG. 2, it can be seen that because the tines 12 pierce the indicating element 16, the color layer beneath the top layer of the indicator element 16 can be seen through the top of the cap 10, as indicated by the shaded areas representing the position of the tines 12.

While tamper indication is important, it is also desirable to provide an air tight seal on a container to protect the contents of the container from atmospheric deterioration in many instances. Because the tines described in the Towns et al. patents pierce the indicating element, when an additional seal is not used, it is necessary to use a sealant coating for purposes of resealing the puncture caused by the tine in the indicating element or by applying a sealant to the puncture areas after insertion of the indicating element into the cap in order to achieve an air tight seal.

While an air tight seal may be achieved by securing a seal to the container after filling but before the cap is secured thereto, because the known tines 12 extend beyond the indicating element 16, they are likely to pierce any seal placed over the opening of the container unless certain steps are taken to avoid such puncturing of the seal. The Towns et al. patents describes the flattening of the tines 12 through a staking operation. Such a staking operating results in the cap assembly, illustrated in FIG. 3, wherein the tine ends are forced into a flat-tearing disposition generally parallel to the undersurface of the cap 10. Once such a flattening operation has been performed, the cap 10 can receive an underlayer 18 having an integrity that is unaffected by the operation of the tines 12. Alternatively, the cap 10 may be attached to a container having a seal placed over the mouth of the container without the risk of the tines 12 piercing the seal and exposing the container contents to atmospheric conditions.

While the tamper indicating closure devices described in the Towns et al. patents provide a high degree of tamper indication, there are several features of the closure devices associated with the piercing of the indicator element that remain to be improved upon. For example, as a result of the piercing of the indicator element by the tines, the color portion of the indicating element is exposed through the cap in the areas of the tines. This exposure of the colored areas may cause some confusion with consumers who are unfamiliar with the tamper indicating device and may believe that any display of color is an indication to tampering.

More significantly, however, are the manufacturing drawbacks associated with the use of tines that pierce the tamper indicating element and extend therethrough. As discussed above, the piercing of the indicating element requires the use of sealant or an additional seal to provide an airtight seal. In addition, when an underlayer or additional seal is to be used, the tines 12 must first be staked, i.e., flattened, before the underlayer or seal may be used to insure that the tines 12 will not pierce the underlayer or seal. This staking operation introduces a step into the cap assembly manufacturing process that, if eliminated, could reduce the cost of manufacturing tamper-indicating closure devices.

SUMMARY OF THE PRESENT INVENTION

Accordingly, it is an object of the present invention to provide a tamper-indicating closure device which avoids the problems associated with tines piercing a tamper indicating element while providing the tamper indicating advantages of such a telltale arrangement.

The present invention is directed to a tamper indicating closure device for securely sealing a container. The tamper indicating closure device comprises a clear cap and an indicator element. The indicator element has at least two layers, a cover layer and a color layer.

The cap includes knife blades which are designed to pass over the indicator element without ripping, tearing or puncturing the indicating element when the cap is rotated e.g., in a clockwise direction, to secure the cap to a container. However, the knife blades are designed so that the cover layer of the indicating element will be torn or ripped when the cap is rotated in the counter clockwise direction to release the cap from a secured relationship with a container.

In accordance with the present invention, each knife blade is radially offset from the center of the cap and extends generally parallel to the radius of the cap terminating in a generally vertical planner knife face that extends in an axial direction. The knife blade is designed to be tapered or ramp shaped so that while one end of the knife blade is the generally vertical planner knife face the other end appears as an inclined projection or ramp.

In accordance with the present invention when the cap is screwed onto the container, the ramp like shape of the knife blades cause the knife blades to pass over the indicating element without tearing or piercing. When the cap is removed from a secured relationship with the container by rotating the cap in, e.g., a counter clockwise direction, the generally vertical knife face tears the cover layer of the indicating element exposing the color layer and thereby providing an indication of tampering.

Because the knife blades of the present invention do not pierce the indicating element during assembly, none of the color layer of the indicator element is visible when a container is secured using the tamper evident closure device of the present invention until the cap is rotated to remove it from a container. Accordingly, the difficulty consumers may have in interpreting the known tamper indicating devices which display the color layer of an indicating element in the area of the tines when the container has not been tampered with is avoided since the color layer remains totally concealed until the container is opened.

In addition to this advantage, the tamper evident closure device of the present invention provides additional advantages over the known devices relating to the manufacture and assembly of the closure device. As discussed above, the knife blades of the present invention do not pierce the indicating element or rip the cover layer of the indicating element until the cap is rotated in an attempt to remove the cap. Accordingly, the step of staking which is required by the prior art closure devices to flatten the tines so that they will not pierce a seal that is placed over a container opening is unnecessary with the device of the present invention.

Furthermore, because the indicator element is not pierced by the knife blades of the present invention, as it is by the tines used in the prior art devices, the indicator element can be used as a seal to protect the contents of a container from atmospheric conditions.

DETAILED DESCRIPTION

Figure 1:
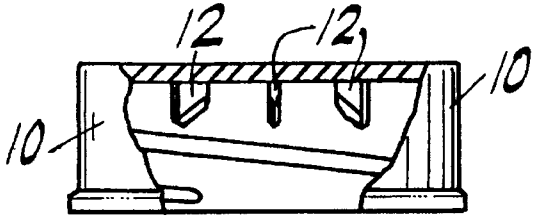
FIG. 1 Prior Art
FIGS. 1 through 4 illustrate known arrangements for tamper evident closure devices using tines as telltale devices.
Figure 2:
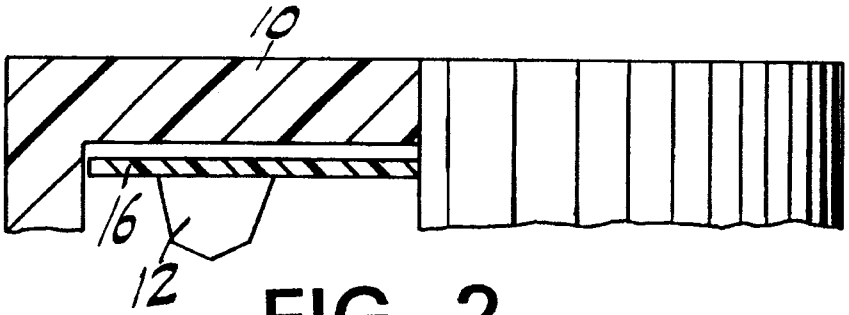
FIG. 2 Prior Art
Figure 3:
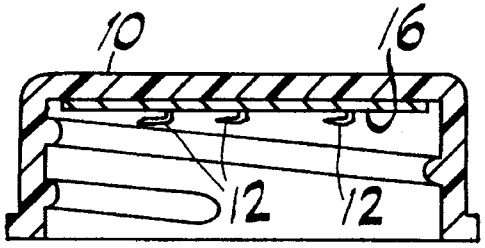
FIG. 3 Prior Art
Figure 4:
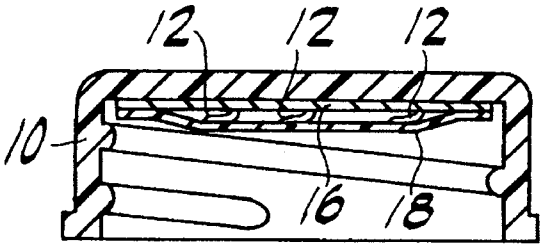
FIG. 4 Prior Art

Referring now to the drawings, and initially to FIG. 1, there is illustrated a hollow cap 100 implemented in accordance with one embodiment of the present invention. The cap 100 may be molded from, e.g., optically clear plastics of butyrate, acetate, nylon lucite, plexiglass as well as other various other suitable materials.

Figure 5A:
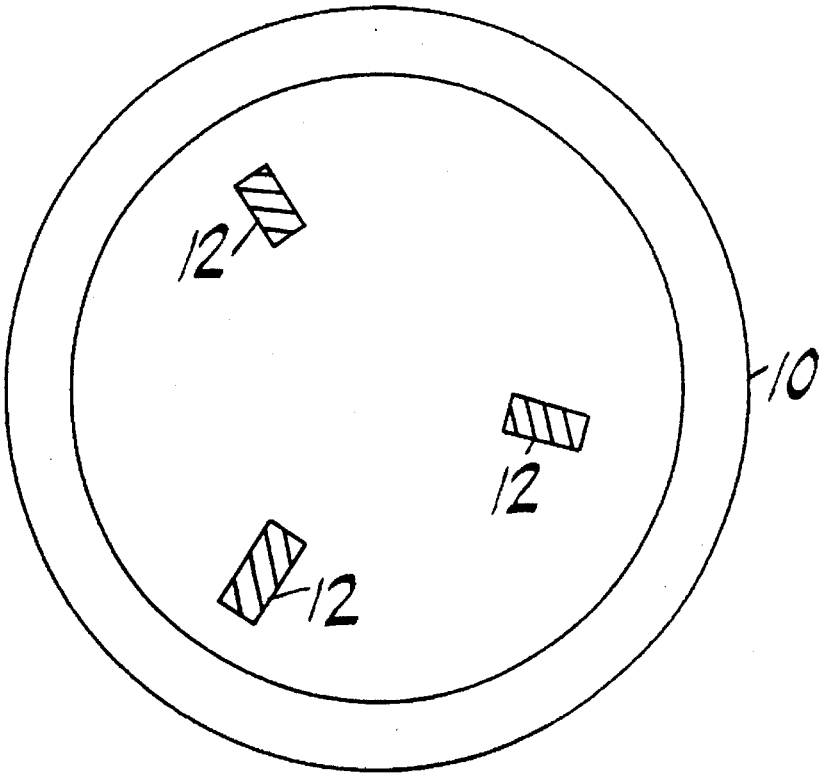
FIG. 5A Prior Art
FIG. 5A is a top planar view of the known tamper evident closure device illustrated in FIG. 2.
Figure 5B:
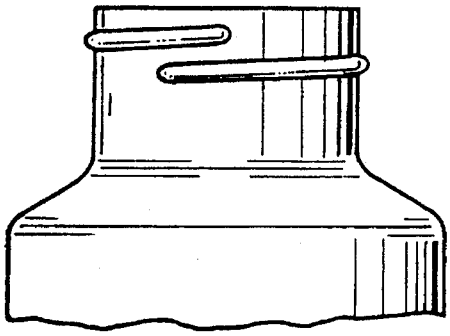
FIG. 5B illustrates a known container suitable for use with the tamper evident closure devices of the present invention.

The cap 100 comprises one or more knife blades 101, 103*a* and a spiral groove 104, molded into the cap, that is used for securing the cap to a container such as the one illustrated in FIG. 5B. Accordingly, because of the spiral groove 104, the cap 100 may be rotated into a releasably secured relation to a container by rotating the cap 100 in a first (clockwise) direction. The cap 100 may then be rotated in a second opposite (counterclockwise) direction for release from said secured relation with the container.

Figure 6:
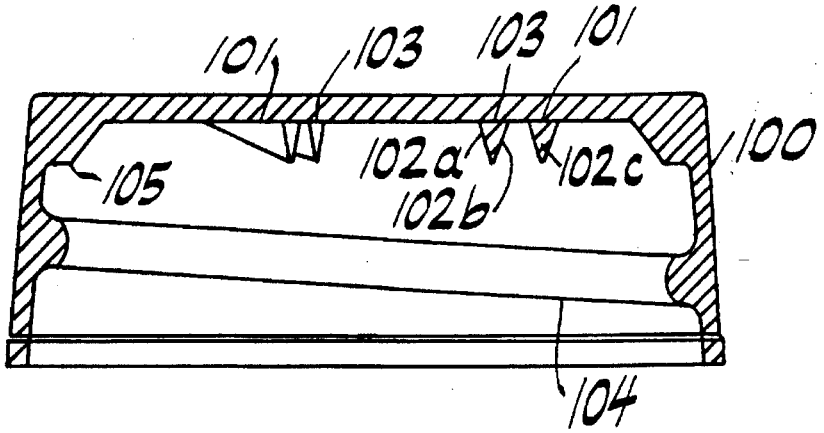
FIG. 6 illustrates a tamper evident closure device, in accordance with one embodiment of the present invention, that is implemented in the form of a cap.

In the embodiment of FIG. 6, inner knife blades 103 are paired with outer knife blades 101 to provide a greater cutting area than would be achieved using a single knife blade.

Each knife blade 101, 103 may be formed integrally with the cap 100, e.g., be molded therewith, and is rigid such that it is not readily deflectable relative to the undersurface 105 of the cap 100.

As can be seen in FIG. 1, both inner and outer knife blades 103, 101 comprise an inclined inner side surface 102*a*, an inclined outer side surface 102*b* and a generally vertical knife face 102*c*.

Figure 7:
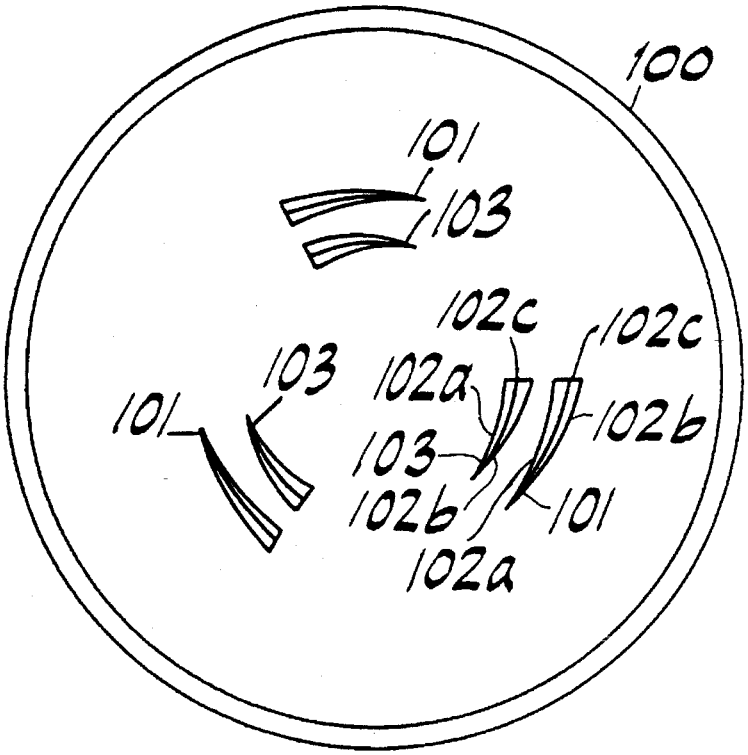
FIG. 7 is a top planar view of the cap of the present invention illustrated in FIG. 6.

Referring now to FIG. 7, there is illustrated a top view of the cap 100. As can be seen in FIG. 7, the knife blades 101, 103 are radially offset from the center of the cap 100 with the knife blades 101, 103 extending generally parallel to the radius of the cap 100.

The inclined inner side surface 102*a* projects vertically outward from the cap inner surface 105 in a downwardly outwardly direction. The inclined outer surface 102*b*, on the other hand, projects vertically downward from the cap inner surface 105 in a downward inwardly direction. In this manner, inclined inner and outer side surfaces 102*a*, 102*b* project outward from the cap inner surface 105 to join together to form a knife blade that has a generally triangular cross section. The inclined inner and outer side surfaces 102*a*, 102*b* of knife blades 101, 103 project out further from the inner cap surface 105 on a gradually increasing basis beginning at a first point and continuing to a second point, wherein the second point represents the apex of the generally vertical knife face 102*c*. As illustrated in FIG. 7, this second point is radially displaced from said first point in a the second (counter clockwise) direction. Accordingly, knife blades 101, 103 appear as tapered triangular projections from said cap inner surface 105 which terminate in generally vertical, triangular knife faces 102*c*.

Because each of the knife blades 101, 103 are secured to the cap 100, they will rotate with the cap 100 as it is rotated in the first (clockwise) direction to secure the cap 100 to a container and is later rotated in the second (counter-clockwise) direction to release the cap 100 from the container.

Figure 8:
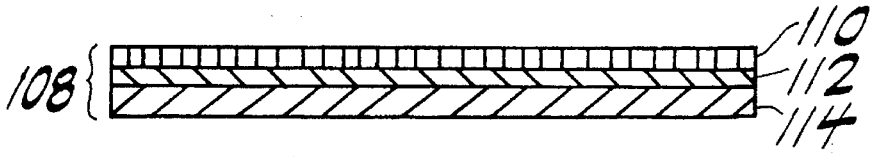
FIG. 8 illustrates a cross-sectional view of an indicator element suitable for use with the cap of FIG. 7.

Referring now to FIG. 8 there is illustrated an indicating element 108 suitable for use with the cap 100 of the present invention. As illustrated, the indicating element comprises three layers, a first covering layer 110, a second color layer 112, and a third optional sealing layer 114. The first layer 110 may be made of paper, foam, or another material suitable for covering the second color indicator layer 112. The third layer 114 is an optional sealing layer designed to protect the contents of the container being sealed by the cap 100 from atmospheric conditions. This third optional layer 114 may be made of aluminum foil or another suitable barrier material.

Figure 9:
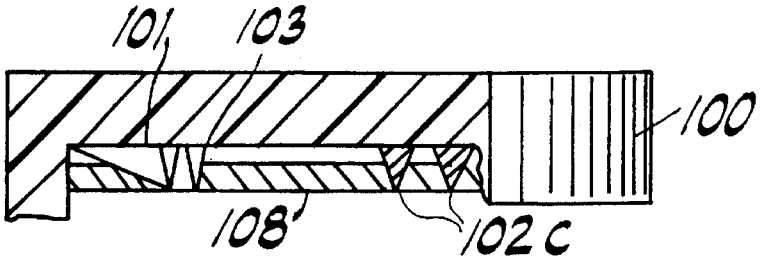
FIG. 9 is a cutaway side view of a cap assembly in accordance with the present invention incorporating a tamper indicating element.

Referring now to FIG. 9, there is illustrated a side view of the cap 100 of the present invention with the indicator element 108 inserted into the cap 100. As illustrated, when assembled, the knife blades 101, 103 depress but do not pierce the indicator element 108. Because the knife blades 101, 103 do not pierce the indicator element 108 when assembled, non of the color layer will be visible until the cap 100 is removed from a container. Accordingly, the chance that a consumer may miss-interpret the tamper indicator of the present invention when in the assembled state is greatly reduced as compared to tamper indicator closure devices that exhibit the color of the color layer at the point the indicating element is pierced by telltales such as tines.

Significantly, because of the tapered or ramp shape of the knife blades 101, 103 they will pass over the indicator element 108 without tearing the indicator element 108 when the cap 100 is rotated in a clockwise direction. Accordingly, the indicator element may be secured to the opening of the container, using a suitable adhesive to insure that the indicator element will not rotate during opening of the container, prior to securing the cap 100 to the container. Alternatively, the indicator element 108 may be inserted into the cap 100 prior to attaching the cap to the container. The indicator element 108 may then be secured to the container, using an adhesive coated on the mouth of the container or the bottom of the indicator element 108, at the same time the cap is secured to the container by rotating the cap in a clockwise direction relative to the container.

As discussed above, the knife blades 101, 103 are designed to pass over the indicator element 108 in a clockwise direction without piercing the indicator element 108. However, when the cap 100 is rotated in the counter-clockwise direction, e.g., to release the cap from a secured position with a container, the vertical knife faces 102*c* will engage the covering layer 110 of the indicating element 108 which is secured to the container causing the covering layer 110 to rip or tear exposing the color layer 112. The color layer 112 will therefor become visible through the top of the cap 100 should someone attempt to remove the cap from the container to which it is secured.

Figure 10:
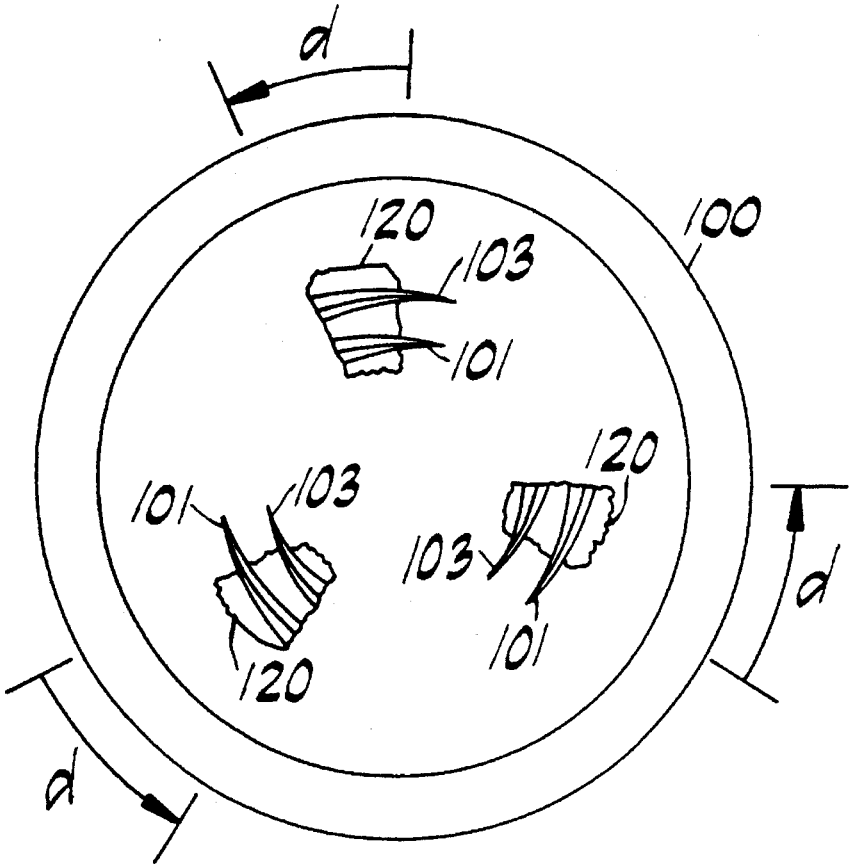
FIG. 10 is a top planar view of the cap assembly illustrated in FIG. 9.

Referring now to FIG. 10, there is illustrated a top view of the cap 100 and indicator element 108 arrangement of the present invention illustrated in FIG. 9 as it will appear after the cap 100 is rotated a distance d in the counter clockwise direction in order to remove the cap 100 from a secured position with a container. As illustrated in FIG. 10, the color layer 112 becomes visible through the top of the cap 100 in areas 120 as the knife faces 102*c* rip the cover layer 108. Accordingly, the exposed areas 120 of the color layer 112 provide a clear indication that the cap has been moved to open the container since the time it was sealed by the manufacturer.

Because the knife blades 101, 103 do not pierce any of the first, or second layers 110, 112 during the cap and container assembly process, the need to stake tines to flatten them in order to avoid piercing of the sealing layer 114 is avoided. Accordingly, the assembly process of the tamper indicating cap 100 and indicator element 108 are simpler than the known systems which require the a staking operation or the addition of sealant to times to compensate for the puncturing effect of the known tine arrangements.

Figure 11:
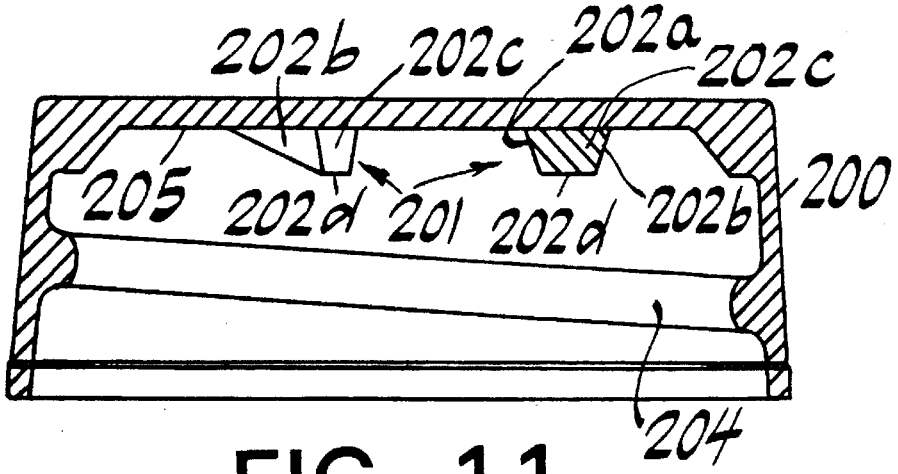
FIG. 11 is a side view of a cap representing another embodiment of the present invention.

Referring know to FIG. 11, there is illustrated another embodiment of the present invention. FIG. 11 illustrates a side view of a hollow cap 200 which incorporates knife blades 201 and a spiral groove 204. As illustrated in FIG. 11, each knife blade 201 comprises an inclined inner side surface 202*a*, an inclined outer side surface 202*b*, a flat inclined top surface 202*d*, and a generally vertical knife face 202*c*.

Figure 12:
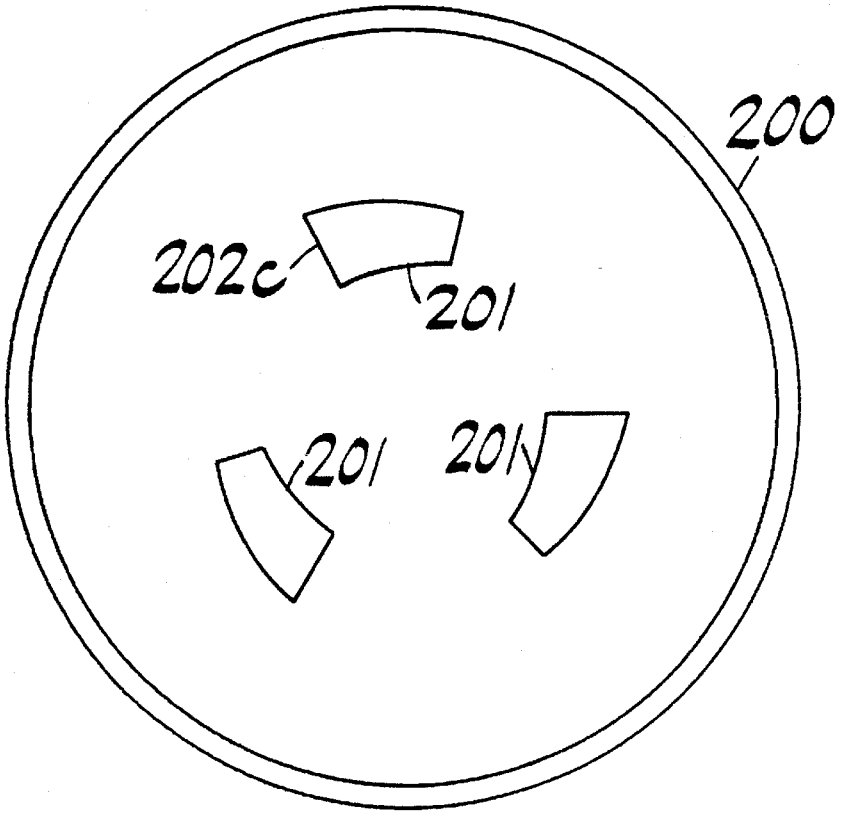
FIG. 12 is a top planar view of the cap illustrated in FIG. 11.

Referring now to FIG. 12 there is illustrated a top view of the cap 200. As can be seen in FIG. 12, the knife blades 201 are radially offset from the center of the cap 200 with knife blades 201 extending generally parallel to the radius of the cap 200.

Referring once again to FIG. 11, it can be seen that the inclined inner knife blade side surface 202*a* projects vertically outward from the cap inner surface 205 in a downwardly outwardly direction. The inclined outer surface 202*b*, on the other hand, projects vertically downward from the cap inner surface 205 in a downward inwardly sloping direction. The knife blade side surfaces 202*a*, 202*b* are connected by the flat inclined top surface 202*d* to form a ramp like structure having a trapezoidal cross section that terminates in the generally vertical trapezoidal shaped knife face 202*d*. The ramp shaped knife blades 201 may be used to provide a tamper-indicating closure device as previously described in regard to the cap 100 illustrate in FIG. 6.

While the telltale arrangement of the present invention has been described as being formed integrally with the cap 100, the knife blade arrangement of the present invention may be implemented in a form that may be used as an insert to standard caps. For example, the telltale device of the present invention may be molded as a disc with knife blades 101, 103 extending therefrom. This disc shaped telltale device may then be inserted and secured to the underside of known caps, through which the telltale of the present invention can be seen, to serve as a tamper indication device.

What is claimed is:

1. A tamper indicating closure device for securely sealing the opening of a threaded container, comprising:

a clear hollow cap including:

i.) a bottom cap surface;

ii.) threaded sidewalls surrounding the bottom cap surface for securing the cap to the threaded container; and ii.) a knife blade offset from the center of the cap and projecting downwardly from said bottom cap surface, the knife blade including:

a tapered inclined inner side surface extending generally parallel to the radius of the cap in a downwardly and outwardly direction;

a tapered inclined outer side surface extending generally parallel to the radius of the cap in a downwardly inwardly direction, the tapered inner and outer side surfaces intersecting to form said knife blade; and a substantially vertical knife face formed by the termination of said intersecting tapered inner and outer side surfaces, the generally vertical knife face extending in an axial direction relative to the cap.

2. The tamper indicating closure device of claim 1, wherein the tapered inclined inner side surface of the knife blade begins to project downwardly from said bottom cap surface at a first position on the bottom cap surface and projects downwardly from said bottom cap surface on an increasing basis until reaching a second position on the bottom cap surfaced radially offset from said first position in a clockwise direction as viewed through the top of the cap;

wherein the tapered inclined outer side surface of the knife blade begins to project downwardly from said bottom cap surface starting at the first position and projects downwardly from said bottom cap surface on an increasing basis until reaching the second position; and wherein the knife face is located at said second position.

3. A tamper indicating closure device for securely sealing the opening of a threaded container, comprising:

a clear hollow cap including:

i.) a bottom cap surface;

ii.) threaded sidewalls surrounding the bottom cap surface for securing the cap to the threaded container; and ii.) a plurality of rigid knife blades offset from the center of the cap and projecting downwardly from said bottom cap surface, at least one of the knife blades including:

a tapered inclined inner side surface extending generally parallel to the radius of the cap in a downwardly and outwardly direction;

a tapered inclined outer side surface extending generally parallel to the radius of the cap in a downwardly inwardly direction, the tapered inner and outer side surfaces intersecting to form said knife blade; and a generally vertical knife face formed by the termination of said intersecting tapered inner and outer side surfaces, the generally vertical knife face extending in an axial direction relative to the cap;

wherein the tapered inclined inner side surface of said knife blade begins to project downwardly from said bottom cap surface at a first position of the bottom cap surface and projects downwardly from said bottom cap surface on increasing basis until reaching a second position on the bottom cap surfaced radially offset from said first position in a clockwise direction as viewed through the top of the cap;

wherein the tapered inclined outer side surface of said knife blade begins to project downwardly from said bottom cap surface starting at the first position and projects downwardly from said bottom cap surface on an increasing basis until reaching the second position; and wherein the knife face is located at said second position.

4. The tamper indicating closure device of claim 3 wherein the plurality of knife blades includes pairs of inner and outer knife blades, the knife blade pairs being separated from each other by a uniform radial distance.

5. The tamper indicating closure device of claim 4, wherein each of said plurality of knife blades has a triangular shaped knife face.

6. The tamper indicating closure device of claim 3, wherein each of said plurality of knife blades has a trapezoidal knife face and includes a planar inclined top surface that give the knife blade a generally ramp shaped appearance.

7. The tamper indicating closure device of claim 6, further comprising:

an indicator element including a covering layer and a color layer, the covering layer being positioned within the cap in contact with the plurality of knife blades, the plurality of knife blades depressing the portions of the indicator element that contact the knife blades without piercing the covering layer.

8. The tamper indicating closure device of claim 7, wherein the indicator element further includes a sealing layer attached to said color layer for providing an airtight seal when the tamper indicating closure device is secured to the container.

9. The tamper indicating closure device of claim 5, further comprising:

an indicator element including a covering layer and a color layer, the covering layer being positioned within the cap in contact with the plurality of knife blades, the plurality of knife blades depressing the portions of the indicator element that contact the knife blades without piercing the covering layer.

10. A tamper indicating closure device for securely sealing the opening of a container, comprising:

a cap including:

i.) a generally clear top portion;

i.) a generally round bottom cap surface;

ii.) attachment means for securing the cap to the container by rotating the cap in a first direction; and ii.) a knife blade offset from the center of the cap, projecting downwardly from said bottom cap surface, and extending generally parallel to the radius of the cap, said knife blade including an inclined ramp surface with tapered sides terminating in a substantially vertical knife face which extends in an axial direction, the inclined ramp surface being positioned to point in the direction the cap is rotated to secure the cap to the container; and an indicator element including a covering layer and a color layer attached to the covering layer, the covering layer being positioned within the cap in contact with the knife blade, the knife blade passing over the indicator element when the cap is rotated in the first direction without piercing the indicator element and operating to tear the indicator element covering layer exposing the color layer when the cap is rotated in a second direction opposite said first direction.

11. The tamper indicating closure device of claim 10, wherein the knife blade is rigid.

12. A tamper indicating closure device for sealing the opening of a container, comprising:

a clear hollow cap including:

i.) a bottom cap surface;

ii.) sidewalls surrounding the bottom cap surface; and ii.) a rigid knife blade offset from the center of the cap and projecting downwardly from said bottom cap surface, the knife blade including:

a tapered inclined inner side surface extending generally parallel to the radius of the cap in a downwardly and outwardly direction;

a tapered inclined outer side surface extending generally parallel to the radius of the cap in a downwardly inwardly direction, the tapered inner and outer side surfaces intersecting to form said knife blade; and a generally vertical knife face formed by the termination of said intersecting tapered inner and outer side surfaces, the generally vertical knife face extending in an axial direction relative to the cap.

13. The tamper indicating closure device of claim 12, wherein the tapered inclined inner side surface of the knife blade begins to project downwardly from said bottom cap surface at a first position on the bottom cap surface and projects downwardly from said bottom cap surface on an increasing basis until reaching a second position on the bottom cap surfaced radially offset from said first position in a clockwise direction as viewed through the top of the cap;

wherein the tapered inclined outer side surface of the knife blade begins to project downwardly from said bottom cap surface starting at the first position and projects downwardly from said bottom cap surface on an increasing basis until reaching the second position; and wherein the knife face is located at said second position.

* * * * *